US012269649B1

(12) United States Patent
Taylor

(10) Patent No.: US 12,269,649 B1
(45) Date of Patent: Apr. 8, 2025

(54) CONTAINER HAVING A COLLAPSIBLE MIDDLE SECTION

(71) Applicant: Taylor Interior Architecture, Inc., Houston, TX (US)

(72) Inventor: Nancy Allyn Taylor, Houston, TX (US)

(73) Assignee: TAYLOR INTERIOR ARCHITECTURE, INC., Houston, TX (US)

( * ) Notice: Subject to any disclaimer, the term of this patent is extended or adjusted under 35 U.S.C. 154(b) by 0 days.

(21) Appl. No.: 18/942,313

(22) Filed: Nov. 8, 2024

Related U.S. Application Data

(63) Continuation of application No. 18/389,366, filed on Nov. 14, 2023.

(51) Int. Cl.
*B65D 3/08* (2006.01)
*A47G 7/06* (2006.01)
*B65D 3/28* (2006.01)

(52) U.S. Cl.
CPC ..... *B65D 3/08* (2013.01); *B65D 3/28* (2013.01); *A47G 7/063* (2013.01)

(58) Field of Classification Search
CPC ... B65D 3/06; B65D 3/08; B65D 3/28; B65D 5/029; B65D 5/5007; B65D 5/5009; B65D 5/5019; A47G 7/063
USPC ..... 229/405, 112.09; 206/784
See application file for complete search history.

(56) References Cited

U.S. PATENT DOCUMENTS 2,745,617 A * 5/1956 Paige ..... A47F 5/114 D6/675
3,134,486 A * 5/1964 Voorhies ..... B65D 5/5007 206/418
3,237,840 A * 3/1966 Keith ..... B65D 5/0218 229/101
3,300,166 A * 1/1967 Wojciechowski ... B65D 5/4283 229/120.32
3,384,222 A * 5/1968 Franco ..... B65D 5/5007 206/277
3,750,934 A * 8/1973 Clinage ..... B65D 5/5007 206/418

(Continued)

FOREIGN PATENT DOCUMENTS

WO WO-2020030415 A1 * 2/2020 ..... A47G 7/063

*Primary Examiner* — Nathan J Newhouse
*Assistant Examiner* — Phillip D Schmidt
(74) *Attorney, Agent, or Firm* — G. Michael Roebuck, PC

(57) ABSTRACT

A container for packaging prepared foods, wine bottles, plants, and flowers suitable for use in greenhouses, floriculture, hydroponic farms, fast-food outlets, gift, and promotional packaging. The container includes but is not limited to a top, bottom, and middle section. The container is made using standard paperboard, standard die cutting equipment and standard cup forming manufacturing machinery. The container has no top rolled rim like a standard paperboard cup. The collapsible middle section is defined by cutouts that ensure that the ribs between cutouts remain separate during collapsing, facilitating radial collapsing of the middle section. Rounded top and bottom ends of the cutouts simplifying paperboard removal of paperboard from the cutouts. Fold lines are provided on the ribs to facilitate folding of the ribs during use. The container can retain water or be used without water.

21 Claims, 17 Drawing Sheets

(56) References Cited

U.S. PATENT DOCUMENTS

| | | | | |
|---|---|---|---|---|
| 3,924,354 | A * | 12/1975 | Gregoire | B65D 5/68<br>47/41.01 |
| 7,571,566 | B1 * | 8/2009 | Taylor | B65D 81/22<br>47/41.01 |
| 2003/0155410 | A1 * | 8/2003 | Cozens | A01G 9/026<br>229/116.1 |
| 2009/0223849 | A1 * | 9/2009 | Farid | B65D 85/34<br>248/346.03 |
| 2018/0118405 | A1 * | 5/2018 | Walling | B65D 5/4608 |

* cited by examiner

CONTAINER HAVING A COLLAPSIBLE MIDDLE SECTION

CROSS REFERENCE TO RELATED APPLICATIONS

This patent application is a continuation of U.S. patent application Ser. No. 18/389,366 filed on 14 Nov. 2023, by Nancy Taylor, entitled, "A CONTAINER HAVING A COLLAPSIBLE MIDDLE SECTION," which is hereby incorporated by reference in its entirety.

BACKGROUND OF THE INVENTION

Customers who buy products, like prepared food items or floral arrangements, often struggle to transport them to their homes or workplaces. For those who prefer not to keep their floral arrangements in water, a sleeve is available. However, if they want to keep the floral arrangements in water, they typically resort to plastic or glass containers. These containers either come at an additional cost or are included in the bouquet's price, making it more expensive.

Current temporary container solutions not only lack aesthetic appeal but are also costly to produce. The added expenses and effort required to transport and store these glass or plastic containers are significant. Unfortunately, most of these containers are discarded soon after the products in the container reach their intended location, contributing significantly to landfill waste. Existing disposable solutions tend to be unwieldy and often do not offer a sturdy yet straightforward way to hold both water and a product such as a floral arrangement. Past attempts to solve these challenges have been subpar. For instance, U.S. Pat. No. 6,665,982 describes a floral bouquet bag, but it does not conveniently hold water and demands a separate container. Plus, it requires assembly before use. Similarly, U.S. Pat. Nos. 6,227,439 and 6,170,739 suggest a flexible container for liquid but do not adequately secure the flowers and need assembly.

Many other patents also fall short, lacking effective solutions to hold the products such as prepared food, wine bottles, hydroponic produce, and floricultural products securely or contain water conveniently. They often demand extensive setup and extensive assembly. There is a clear need in the market for a solution that temporarily contains products such as prepared food, wine bottles, hydroponic produce, and floricultural products securely or contain water conveniently. An efficient, easy-to-use, and eco-friendly alternative that streamlines manufacturing, shipping, storage, usage, and disposal processes is needed.

FIELD OF THE INVENTION

The present invention relates to a container for prepared food items such as take-out finger foods, wine bottles, hydroponic produce, and floricultural products when in use with and without liquids.

SUMMARY OF THE INVENTION

A container for packaging prepared foods, wine bottles, plants, and flowers suitable for use in greenhouses, floriculture, hydroponic farms, fast-food outlets, gift, and promotional packaging. The container includes but is not limited to a top, bottom, and middle section. The container is made using standard paperboard, standard die cutting equipment and standard cup forming manufacturing machinery. The container has no top rim like a standard paperboard cup. The collapsible middle section is defined by cutouts that ensure that the ribs between cutouts remain separate during collapsing, facilitating radial collapsing of the middle section. Rounded top and bottom ends of the cutouts simplifying paperboard removal of paperboard from the cutouts. Fold lines are provided on the ribs to facilitate folding of the ribs during use. The container can retain water or be used without water.

BRIEF DESCRIPTION OF THE DRAWINGS

While the specification concludes with claims particularly pointing out and distinctly claiming the invention, it is believed that the present invention will be better understood from the following description taken in conjunction with the accompanying drawing in which:

DETAILED DESCRIPTION OF A PARTICULAR ILLUSTRATIVE EMBODIMENT

Figure 1:
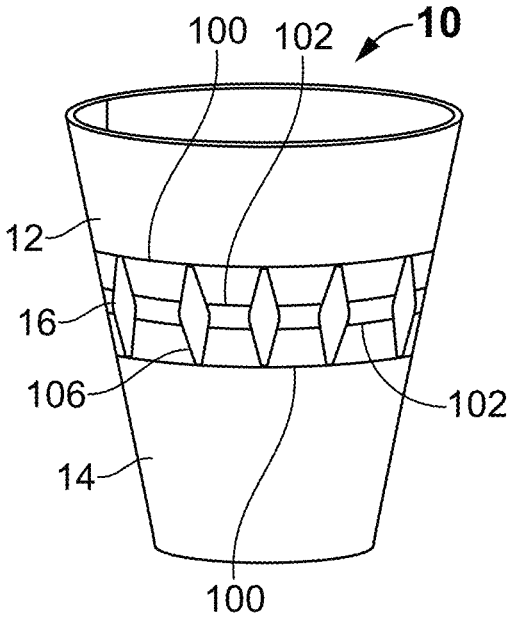
FIG. 1 shows the container in a pre use state, that is, before the middle section collapses.

The present invention pertains to a versatile container ideal for packaging prepared foods, wine bottles, plants, and flowers suitable for use in greenhouses, floriculture, hydroponic farms, fast-food outlets, gifts, and promotional packaging. Suitable for use in greenhouses, hydroponic farms, fast-food outlets, and gift packaging, this container boasts multiple benefits. The key features of the invention include but are not limited to: Design: The container comprises three sections: top, middle (collapsible due to cutouts), and bottom. This multi-sectioned structure facilitates separate storage of items, e.g., a burger in the top and fries in the bottom. The container has a first non-collapsed shape when the collapsible middle portion of the container is not collapsed and thus ready to receive a product. The container has a second collapsed shape when the collapsible middle portion is collapsed and retains a product.

In a particular illustrative embodiment of the invention a container for packaging prepared foods, wine bottles, plants, and flowers suitable for use in greenhouses, floriculture, hydroponic farms, fast-food outlets, gift, and promotional packaging is disclosed. The container includes but is not limited to a top, bottom, and middle section. The container is made using standard paperboard, standard die cutting equipment and standard cup forming manufacturing machinery. The container has no top rim like a standard paperboard cup. The collapsible middle section is defined by cutouts that ensure that the ribs between cutouts remain separate during collapsing, facilitating radial collapsing of the middle section. Rounded top and bottom ends of the cutouts simplifying paperboard removal of paperboard from the cutouts. Fold lines are provided on the ribs to facilitate folding of the ribs when the container middle section collapses for use. The container can retain water or be used without water. A saturated sponge can be provided to provide moisture for floriculture items to be shipped air freight without loose water.

Traditional cup containers made from semi-rigid paperboard or similar stiff, foldable material typically have an inverted, slightly tapering conical design. This design gradually widens from a sealed, smaller diameter base to a larger diameter open top, maintaining a circular cross-section throughout its height. This design is cost-effective to produce from a blank, easily stackable for transport and storage, and offers enough rigidity for most uses.

The present invention involves a specifically revised container design, which retains the manufacturing efficiency and robustness of traditional cups. Additionally, it introduces novel features, including making it suitable for assorted items and purposes, including carrying liquids.

In a particular illustrative embodiment of the present invention, an improved container is provided that is superior to the inventor's prior U.S. Pat. No. 7,571,566 entitled "Container and Method of Use," issued Aug. 11, 2009, hereinafter referred to as "the '566 patent," which is hereby incorporated by herein by reference in its entirety.

In some aspects, the techniques described herein relate to a container including: a container having a semi-rigid top section, a semi-rigid bottom section and a collapsible middle section, wherein the container has an non-collapsed shape, wherein the top section is open to receive an item, the middle section having a non-collapsed shape with an non-collapsed diameter, wherein the collapsible middle section is configured to be depressed inwardly to form a collapsed middle section that has a collapsed diameter smaller than the non-collapsed diameter, wherein the container is configured to receive a product in the non-collapsed shape and wherein the collapsible middle section is depressed radially inwardly to secure the product in the container; a longitudinal axis for the container, wherein the longitudinal axis is vertical; cutouts formed in the collapsible middle section; and ribs formed between the cutouts configured to fold radially inward toward the longitudinal axis when the collapsible middle section is depressed radially inwardly. In some aspects of the invention, the container is suitable for use on a variety of container shapes and sizes, conical and cylindrical and any other shape available for manufacture on cup forming machinery, including but not limited to rimless round tapered containers from 4 ounces to 128 ounces.

In some aspects, the techniques described herein relate to a container, wherein the container is made from a material that is semi-impermeable to liquid. In some aspects, the techniques described herein relate to a container, wherein the cutouts have a top end, a bottom end, a left side and a right side, and a middle portion between the top end and the bottom end, wherein the middle portion of the cutout is wider than the top end and the bottom end of the cutout, configured so that edges of two ribs on each side of the cutout do not touch each other when the middle portion is collapsed. In some aspects, the techniques described herein relate to a cutout, wherein the top and bottom ends form an acute angle with a curved peak at the top and bottom of the cutout.

In some aspects, the techniques described herein relate to a cutout wherein the left side and right side of the cutout are each configured to form an obtuse angle. In some aspects, the techniques described herein relate to a container, further including: a first horizontal fold line on an outside surface of the middle section of at least one of the ribs wherein the first horizontal fold line facilitates bending of a middle section of the ribs inward. In some aspects, the techniques described herein relate to a container, further including: a second horizontal fold line made on an inside surface of the top section of at least one of the ribs on each side of the cutout wherein a second horizontal fold line facilitates collapsing of top section of the ribs inward.

In some aspects, the techniques described herein relate to a container, further including: a third horizontal fold line on an outside surface of the bottom section of the ribs on each side of the cutout wherein the third horizontal fold line facilitates collapsing of the bottom section of ribs inward. In some aspects, the techniques described herein relate to a container, wherein the fold line is formed by a kiss cut, the container further including: a first horizontal kiss cut on an inside surface of the middle section of at least one of the ribs wherein the first horizontal kiss cut facilitates bending of the middle section of the ribs inward. In some aspects, the techniques described herein relate to a container, wherein the fold line is made by a laser cut.

In some aspects, the techniques described herein relate to a container, where in the fold line is made by a chemical process. In some aspects, the techniques described herein relate to a container, wherein the container is made by a three dimensional printer using a PLA material and the first fold line is made by the three dimensional printer. In some aspects, the techniques described herein relate to a container, wherein where in the container is manufactured using food safe cup forming machinery, food safe die cutting equipment and the product is prepared food. In some aspects, the techniques described herein relate to a container, wherein the product further includes water. In some aspects, the techniques described herein relate to a container, wherein the container is suitable for cold chain processing of cut flowers.

In some aspects, the techniques described herein relate to a container, wherein the container is stackable. In some aspects, the techniques described herein relate to a container wherein the container is self-sufficient and does not require an inner member to house the product or a liquid. In some aspects, the techniques described herein relate to a container wherein the collapsible section is collapsed inwardly to a second position while the non-collapsible sections retain their shape to support the product in the container.

In some aspects, the techniques described herein relate to a method of containing at least one product, the method including: providing a container having a first section, a second section, and a collapsible middle section between the first section and the second section, the sections all being made of a common integral piece of non-collapsible material; forming cutouts in the middle section of the container to form ribs in the middle section; placing a product into the container; collapsing the middle section to retain the product in the container.

In some aspects, the techniques described herein relate to a container for housing a product, the container including: a container having a side with a circular cross-section, a closed bottom section, and an open top section to receive a product; the container having a top, bottom and middle section, the container being made of a common integral piece of paperboard, causing the top and bottom sections of the container to be non-foldable, and to have a rigidity that will support a product placed in the container; a plurality of cutouts and ribs between the cutouts made in the middle section; and the top and bottom sections having a first position with respect to each other prior to insertion of at least one product when the middle section is not collapsed and a second position when the ribs in the middle section are collapsed into securing engagement with the product.

Figure 13:
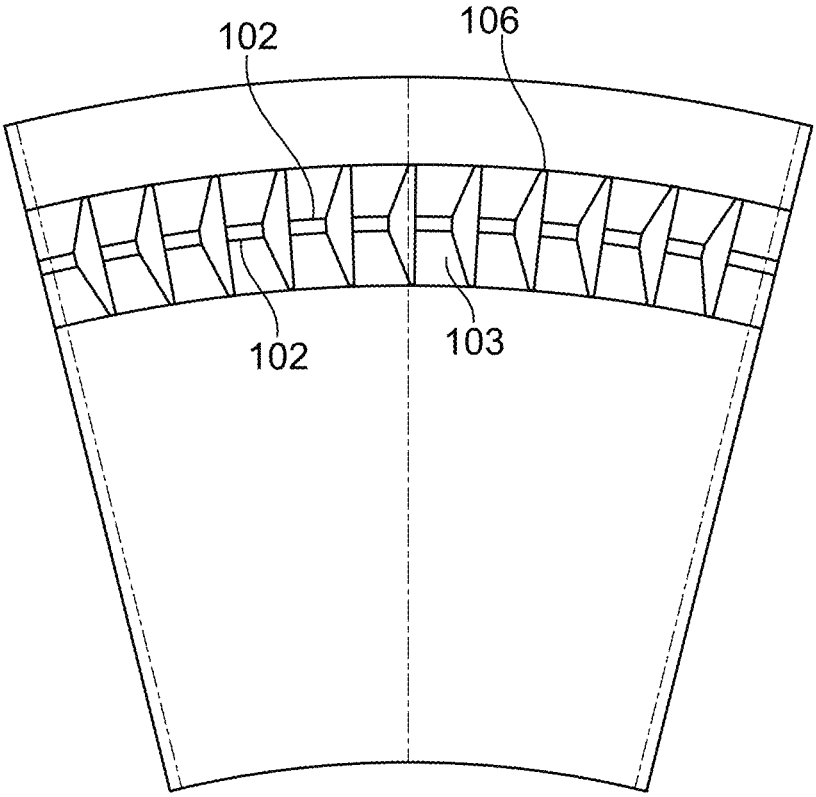
FIG. 13 is depiction of a particular illustrative embodiment of the invention depicting cutouts configured as asymmetrical cuts that are asymmetrical shaped.
Figure 14:
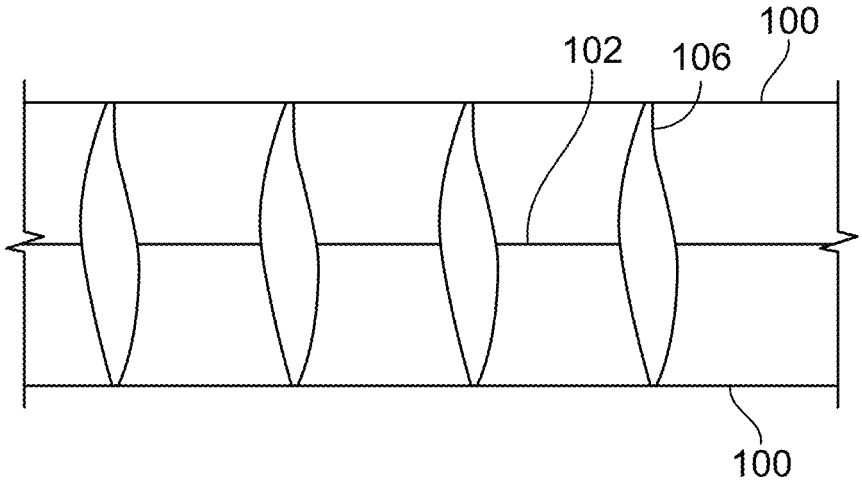
FIG. 14 is depiction of a particular illustrative embodiment of the invention depicting cutouts configured as asymmetrical curved cuts that are leaf shaped.

In a particular illustrative embodiment of the invention, a container having a collapsible middle section is provided that is provided for a more easily collapsible middle section by eliminating the rigid top rim formed at the top of the container and providing cutouts in the middle collapsible section of the container, so that edges of the cutouts do not touch each other during collapsing to resist collapsing of the middle section of the container. The cutouts form holes surrounded by ribs of material left after the cutout is removed, in the middle collapsible section of the container. Fold lines are provided on the inside and outside ribs surrounding the cutouts in the collapsible middle sections of the container having a collapsible middle section, to aid in uniform bending of the ribs inward when the cutouts are bent inward toward a central vertical longitudinal axis of the container having a collapsible middle section located between the cutouts. In another particular embodiment of the invention, the cutouts are asymmetrical cutouts that have a squared off top and bottom at the acute angle top and bottom of the cutouts as shown in FIG. 13. The cutout has an obtuse angle on the left side and forms a straight vertical line on the right side of the cutout. In another particular embodiment of the invention, the cutouts are leaf shaped as shown in FIG. 14.

In one particular illustrative embodiment of the invention, a container is provided, the container capable of containing a liquid and at least one stem of a floral product having a first section and a second section, the container comprising a middle section capable of collapsing around at least a section of each stem between the first section and the second section to support the floral product in the water. The preferred embodiment is capable of containing water and flowers for at least one week. In a most preferred embodiment, the middle section includes a maintenance means such as either a paper or a wire Lie around the collapsed middle section.

Though those skilled in the art will recognize that a variety of materials may be used to form the container, it is preferable for the container to be made of semi-rigid laminated paperboard having at least two laminated layers, that has a coating or lamination of plastic or wax. In a preferred embodiment, the container is made of recyclable material or a biodegradable material. Further, the container can be made of plastic. The container can also be three dimensionally (3d) printed using a Polylactic Acid, commonly known as PLA, one of the most popular materials used in desktop 3D printing. It is the default filament of choice for most extrusion-based 3D printers because it can be printed at a low temperature and does not require a heated bed.

The disclosure includes a method of using the container to contain liquid and floral products for preferably at least one week. When used as a container having a collapsible middle section, the container crimps about at least a section of the stem of each floral product and holds each floral product in liquid. It is advantageous to manufacture the containers so as to allow stacking of the containers prior to use. Those skilled in the art will recognize that additional decorative accessories such as ribbons about the middle section may be advantageous.

The present invention provides numerous advantages, including but not limited to: Manufacturing Efficiency: Made using standard paperboard and cup forming machinery, this rimless container is more energy-efficient and quicker to produce than traditional cups. The absence of a rim eradicates the need for heat-intensive rim formation. Versatility: The container can be crafted in various shapes, including cylindrical or truncated cone forms, fitting seamlessly in car cup holders, making it user-friendly for consumers on-the-go. Ventilation: The middle cutouts not only enable collapsibility but also function as vents, ensuring foods like fries remain crisp.

The container is manufactured using to a standard conventional commercially available machine model related to cup forming manufacturing, which specializes in the design and manufacture of forming machines for paperboard cups, paperboard canisters, and custom paperboard packages. The conventional machine is an example of a machine designed for producing paperboard cups. Here is a general idea of how such machines work: Blank Feeding: Paperboard blanks are fed into the machine. Heating & Molding: The paperboard blanks are heated and molded into the shape of a cup. Sealing: The side and bottom seams are sealed. Trimming: Excess material is trimmed from the top to create a smooth edge. Printing & Branding: Some machines also incorporate printing mechanisms for branding the cups. Quality Checks: Advanced machines incorporate sensors and cameras for automatic quality checks. Output & Collection: The finished cups are output and collected in batches. The exact features, capacity, and output of the machine would depend on its specific configuration and the requirements of the manufacturer.

Environmental Consideration: Constructed from biodegradable paperboard and standard paperboard, the container minimizes plastic waste in a landfill. It can sustain water for a week, making it also ideal for flower transportation with and without loose water, adhering to international shipping standards. Durability: Available in food-safe paperboard, it is crucial to select a paperboard sturdy enough to bear weight, be it for wine bottles or prepared food items. Applications: Beyond food, the container is invaluable for flower farmers and greenhouses. Flowers can be delivered in these disposable containers, reducing breakage risks and inconvenience for recipients. The design also simplifies greenhouse plant propagation, hydroponics, and transportation of water-sensitive items. Additional Embodiment: An external layer of craft paper can encase the container, useful for carrying hefty bouquets. This allows for water-less flower air freight transportation using saturated sponges, ensuring freshness while adhering to cold chain processing standards. Previous Containers: In contrast to traditional plastic buckets requiring sanitization and return transportation, the present container is disposable and more eco-friendly, reducing plastic landfill waste.

Cold chain processing refers to the management of the temperature of perishable products in order to maintain their quality and safety from the point of production to the point of consumption. It is a series of precisely coordinated events to store, transport, and handle these products within a recommended temperature range. Here is a breakdown of the components involved in cold chain processing: Storage Equipment: This includes refrigerators, cold rooms, and freezer units where products are stored before and after transport. Transport: Products are moved using refrigerated trucks, vans, ships, or planes. These vehicles are equipped with temperature control mechanisms to ensure the goods remain within a specific temperature range during transit.

Temperature Monitoring: Various devices, such as temperature loggers and real-time monitoring systems, are used to keep track of the temperature inside storage and transport units. This ensures that products are maintained within their required temperature range and that deviations are promptly detected and addressed. Packaging: Specialized packaging materials, such as insulated boxes or containers with cold packs or dry ice, can be used to further maintain temperature control. The present invention is particularly suitable for packaging for cold chain processing.

Handling: This involves all the processes where products might be exposed to outside temperatures, such as during loading and unloading. Proper management ensures that these exposures are minimized or controlled. Standard Operating Procedures (SOPs): Cold chain processing is governed by SOPs that detail how products should be handled at each step, including the acceptable temperature ranges, duration of exposures, and corrective actions in case of deviations. Training: Employees involved in the cold chain must be properly trained to understand the importance of temperature control and the methods to ensure it. Cold chain processing is vital for many products, including Pharmaceuticals: Many medications and vaccines are temperature-sensitive and can lose their efficacy if exposed to temperatures outside their recommended range. Foods: Perishable foods like meat, dairy, fruits, and vegetables need to be kept at specific temperatures to prevent spoilage and ensure safety.

Biological samples: Samples like blood, tissues, and organs for transplantation also require cold chain management. The integrity of the cold chain is crucial. Breaks or lapses in the cold chain can result in product spoilage, loss of efficacy in medicines, or even health risks to consumers. Proper management, therefore, ensures the quality, safety, and efficacy of temperature-sensitive products from their source to their final destination.

Container Mechanics: The collapsible middle is defined by fold lines, either indented, cut, or kiss-cut. The design ensures the ribs between cutouts remain separate during collapsing, facilitating smooth compression. The rounded top edges of the cutouts ease manufacturing by simplifying paperboard removal without remnants. This innovative container addresses the needs of various industries, offering an eco-friendly, efficient, and versatile solution for packaging and transportation.

The present invention is described with respect to floricultural products such as flowers, plants, greenhouse plant propagation, hydroponics and similar objects that are preferably placed in a liquid such as water. The present invention is also useful for containing prepared food items and objects that are not placed in water. Floral products particularly include Cut flowers. The term floral products do not include potted plants such as plants planted in soil in a pot. Though the container is described in this setting, those skilled in the art will recognize that containers capable of containing liquids and objects, and significant variations thereof are considered to be within the scope of the invention.

Figure 2:
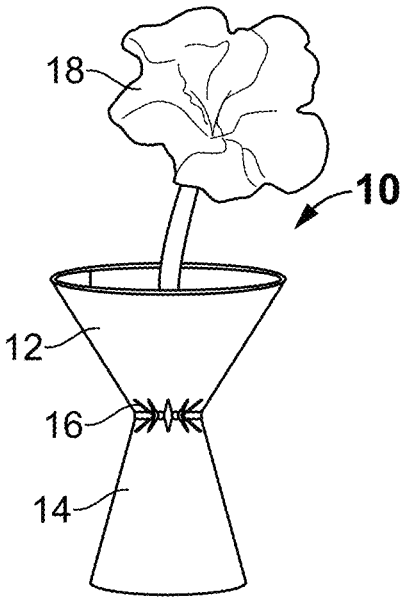
FIG. 2 shows container in an "in use" state, that is, after the middle section has been collapsed to engage a stem of a floral product, such as a flower.
Figure 3:
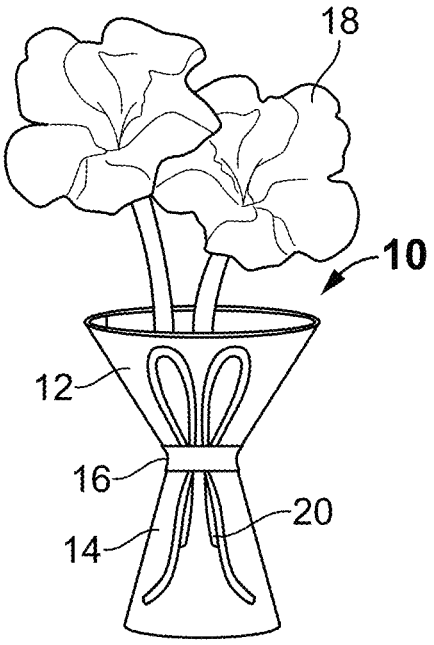
FIG. 3 show decorative tie used to decorate the collapsed container and hold the collapsed middle section in place.

Turning now to FIG. 1, FIG. 1 is a perspective view of an illustrative embodiment of the invention. As shown in FIG. 1, conical container 10 has a top section 12, a bottom section 14, and a collapsible middle section 16. FIG. 1 shows the conical container in a pre use state, that is, before the middle section 16 is collapsed. FIG. 2 shows conical container 10 in an "in use" state, that is, after the middle section 16 has been collapsed to engage a stem of a floral product, such as a flower 18. FIG. 3 show decorative tie 20 used to decorate the collapsed container and hold the collapsed middle section 16 in place.

Figure 4:
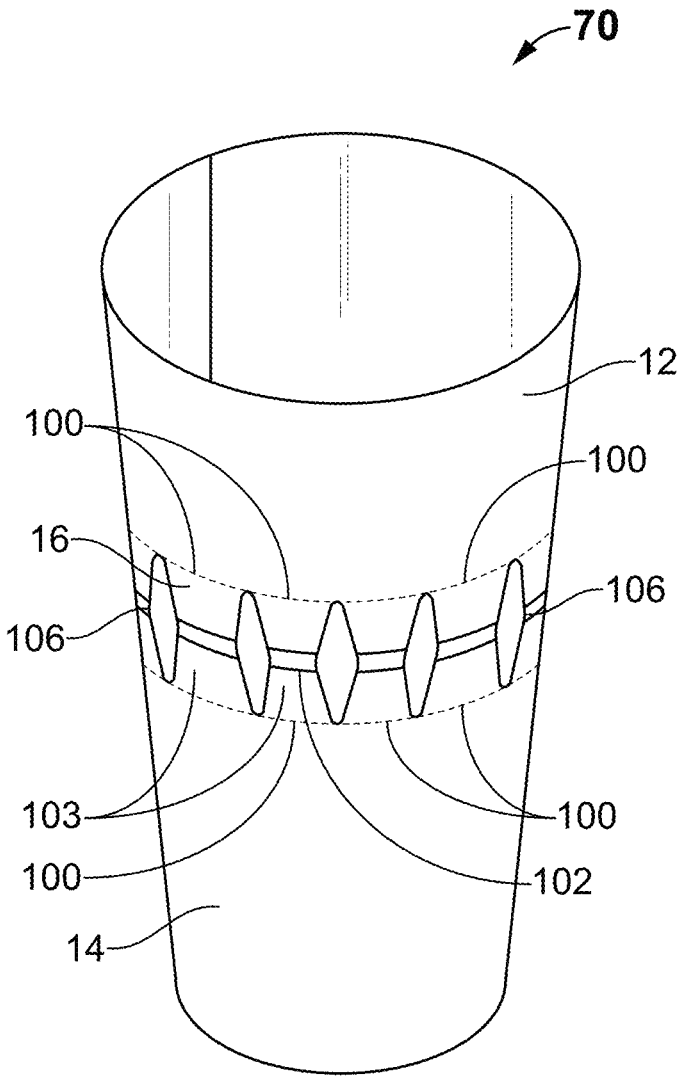
FIG. 4 in a particular illustrative embodiment of the invention cutouts are cut into the sides of the conical container leaving material referred to herein as a "rib," between each cutout.
Figure 5:
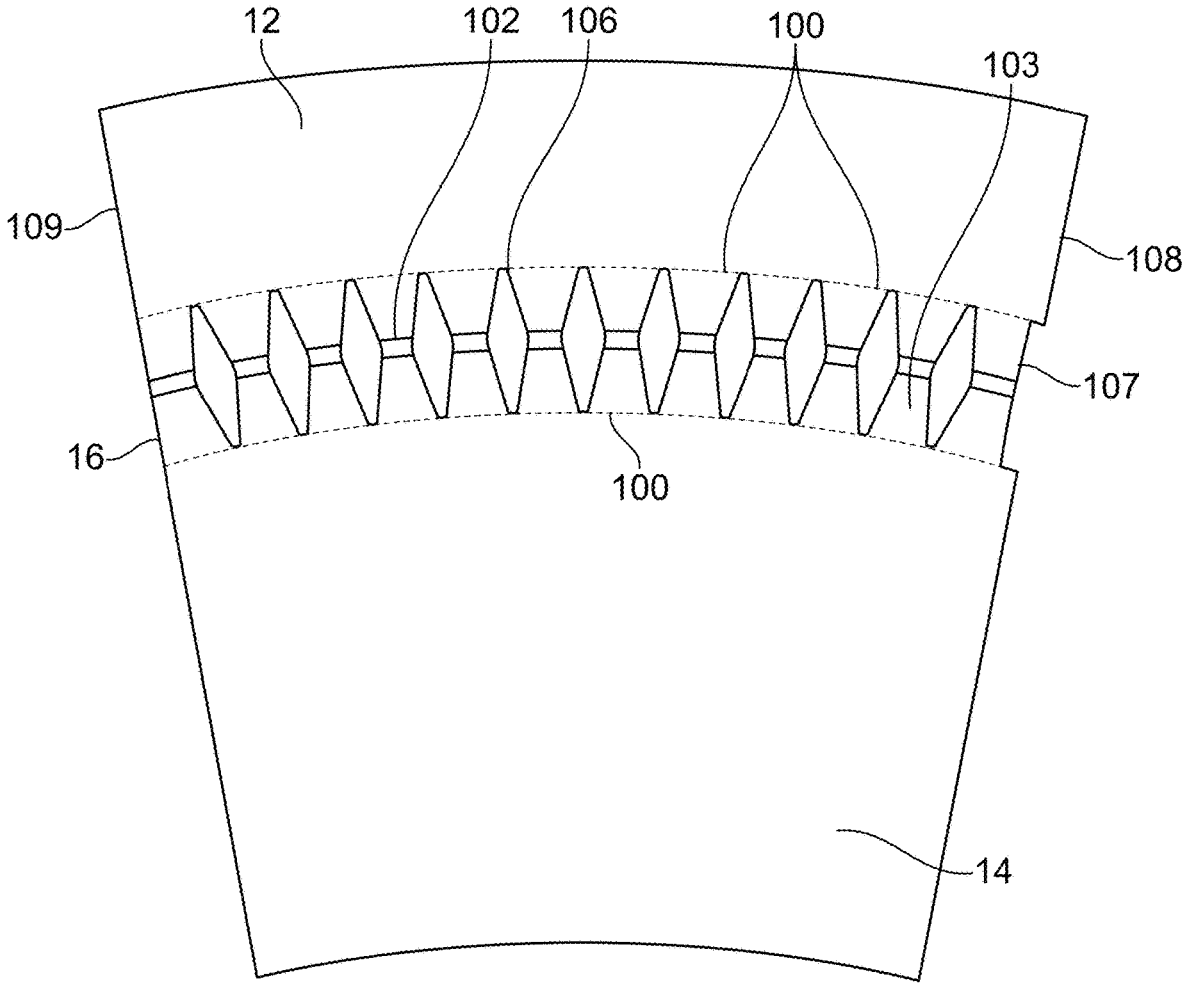
FIG. 5 is a depiction of a die cut laminated paperboard sidewall blank having a right edge and a left edge.

Turning now to FIG. 4, in a particular illustrative embodiment of the invention cutouts 106 are cut into the sides of the conical container 70 leaving material 103 referred to herein as a "rib," between each cutout 106. Bending resistance reduction lines, shown in FIG. 4 as kiss cuts 100, which are discussed in more detail below, are cut into the outside surface of the paperboard forming the conical container. The bending resistance reduction lines, shown here as kiss cuts 100 are located at the top end and bottom end of each rib 103. The kiss cuts 100 facilitate folding the ribs 103 inward toward a central longitudinal vertical axis of the conical container 70, without deforming the top section 12 and the bottom section 14 when the collapsible middle section is collapsed. Kiss cuts 102 are cut into the inside surface of the container at the center of each rib 103 to facilitate bending of the center of the rib inward toward the central longitudinal vertical axis of the conical container 70, FIG. 5 is a depiction of a die cut laminated paperboard sidewall blank having a right edge 108 and a left edge 109. The die cut laminated paperboard is rolled into a cylinder to form a container 70. The right and left edges are joined overlapping to form a seam that is sealed to form conical container 70. Cutout 107 made in right edge 108 to reduce rigidity of the seam formed by overlapping the left and right edges. Cutout 107 reduces the amount of material, in this case, laminated paperboard in the seam making the middle section easier to collapse without deforming the top section 12 and the bottom section 14.

Figure 6:
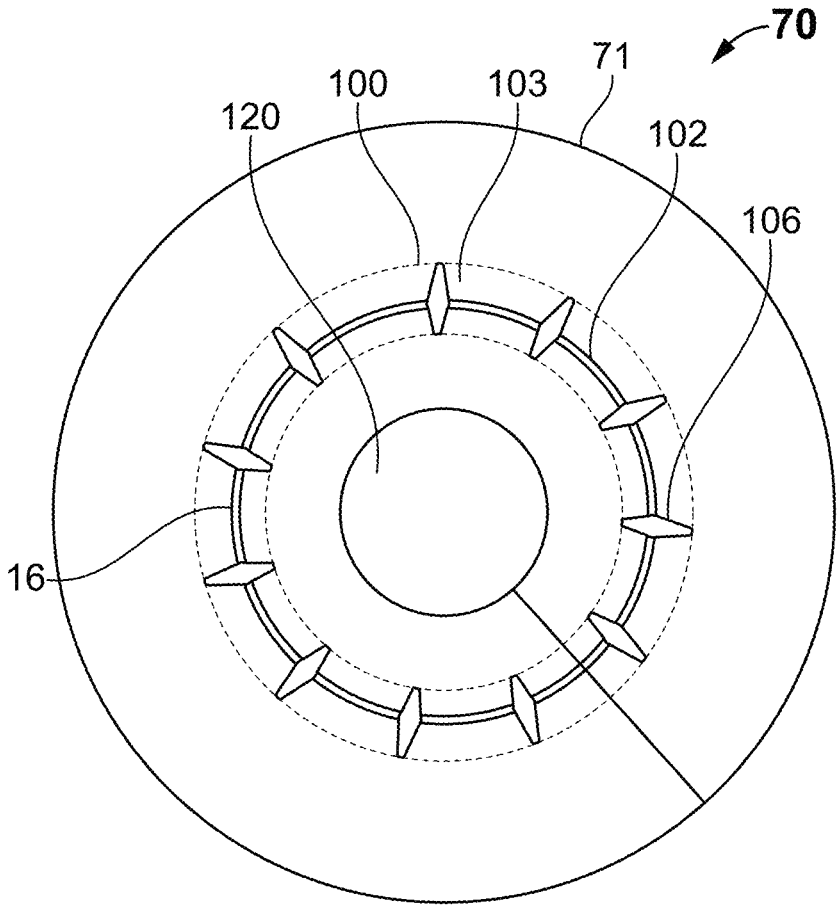
FIG. 6 is a top view of container showing the top opening of container and bottom of container.

Turning now to FIG. 6, FIG. 6 is a top view of container 70 showing top opening 71 without a top rolled rim of container 70 without a top rolled rim and a bottom of container 120. Cutouts 106 and ribs 103 are shown surrounding the middle section 16 of container 70. Kiss cuts 100 are shown (for clarity) that have been made on the exterior surface of container 70. Kiss cuts 102 are shown made on the interior surface at the center of the cutouts.

Figure 7:
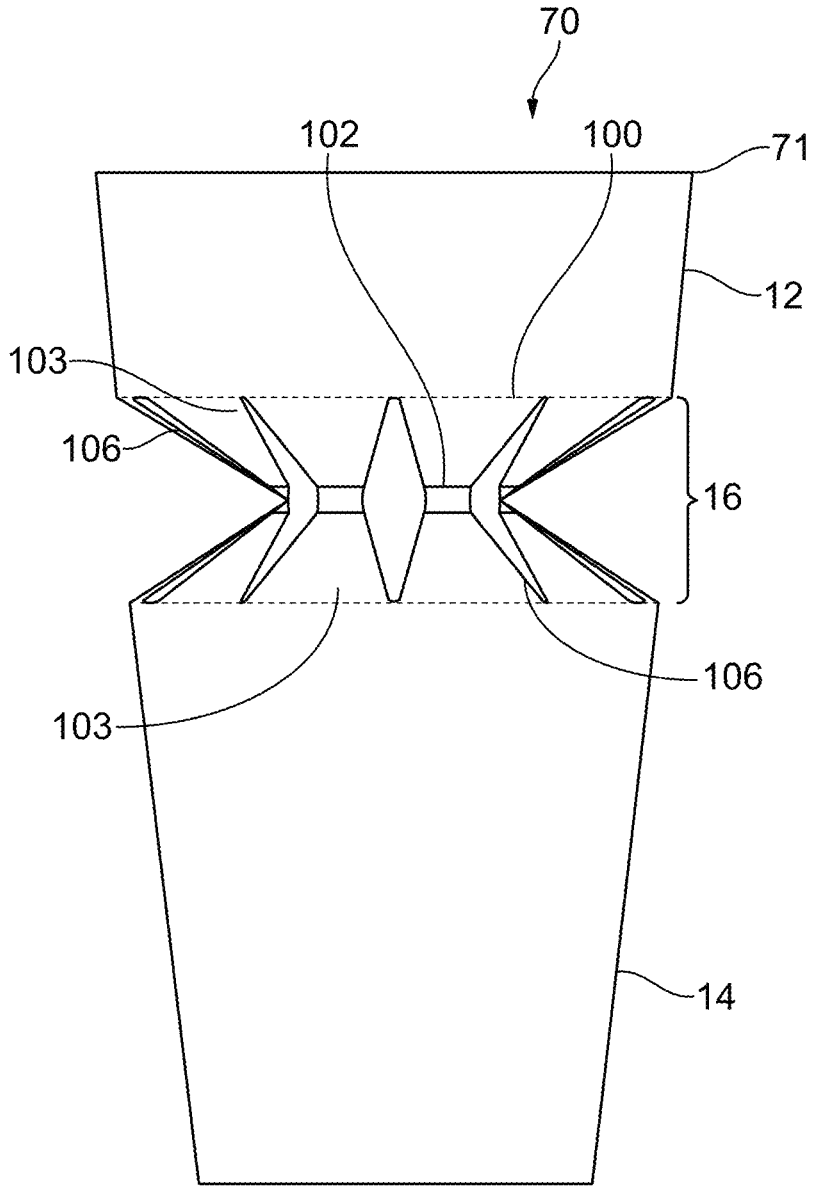
FIG. 7 is a side view of container in the collapsed in use position as shown in FIG. 2.
Figure 8:
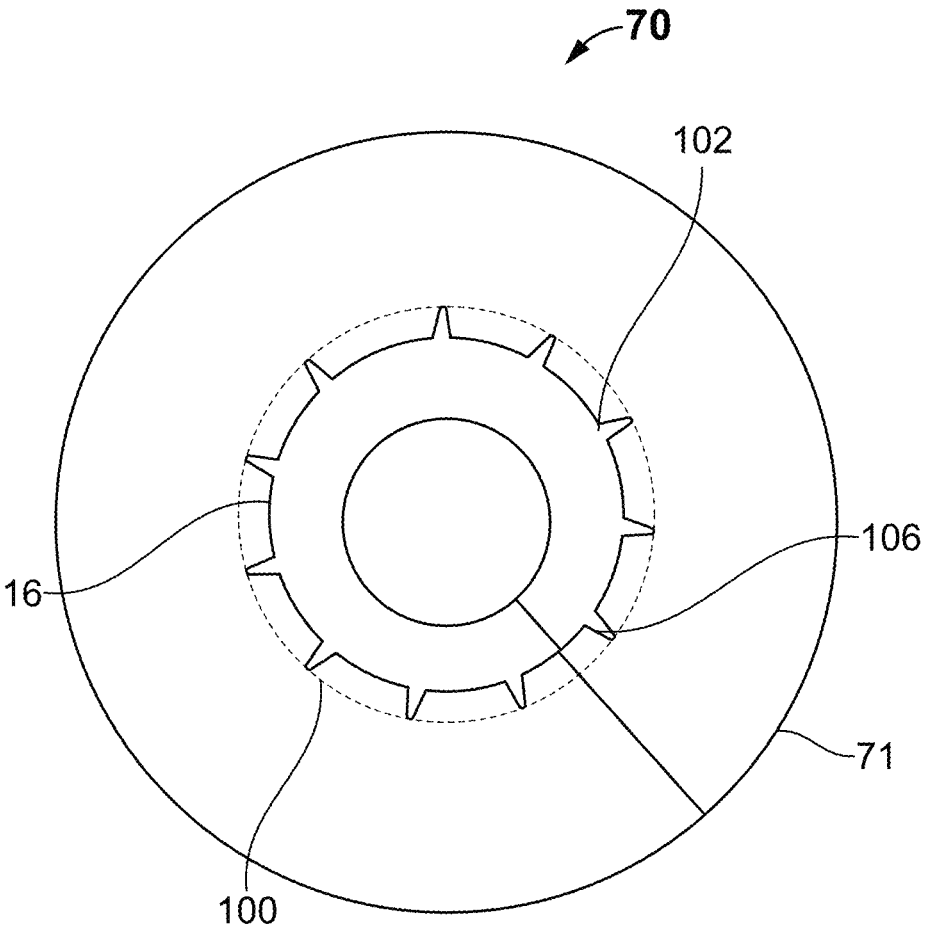
FIG. 8 is a top view looking into the top of collapsed middle section of a container depicted in FIG. 7.

Turning now to FIG. 7, FIG. 7 is a side view of container 70 in the collapsed in use position as shown in FIG. 2. As shown in FIG. 7, adjacent rib edges formed on each side of each cutout 106, do not touch each other during collapsing the middle section 16 ribs of container 70 into the use position. In another particular embodiment of the invention, adjacent rib edges formed on each side of each cutout 106, do not interfere with each other during collapsing the middle section ribs of container 70 into the use position having a top end 71 without top rolled rim. FIG. 8 is a top view looking into the top of collapsed middle section of container 70 depicted in FIG. 7.

Figure 9:
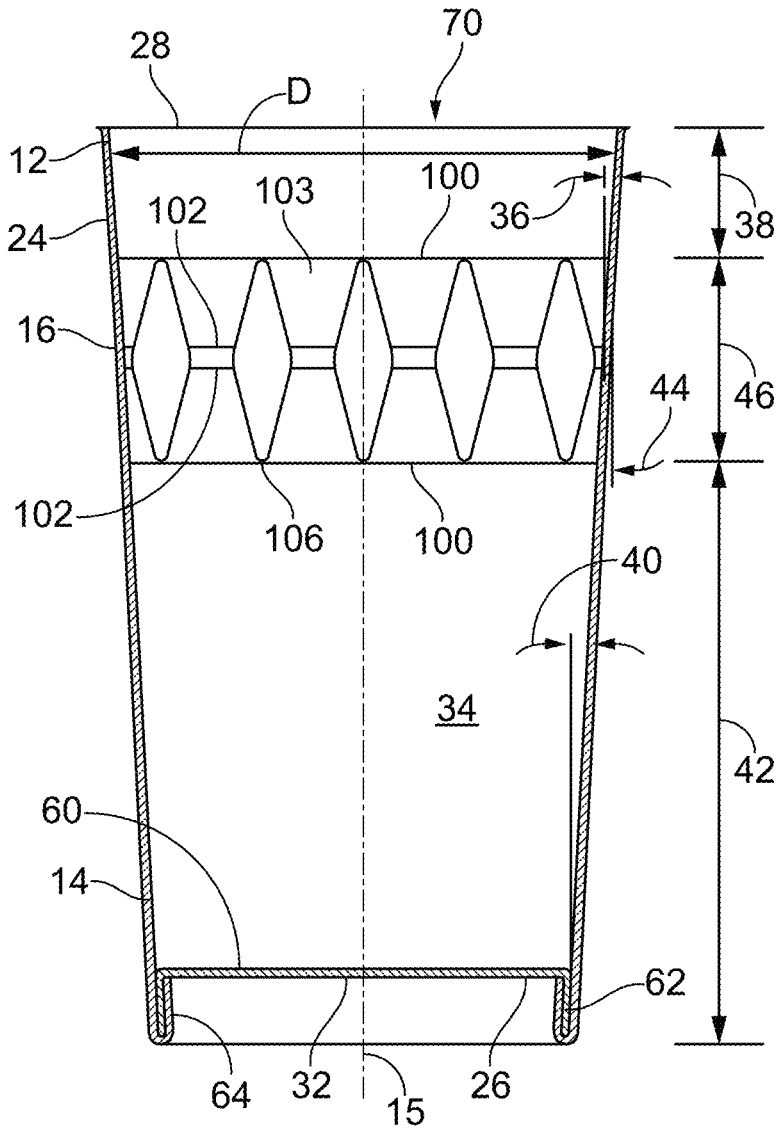
FIG. 9 depicts a sidewall having a shape of a truncated cone where the tapered wall of the first top section has a slightly larger diameter than the tapered wall of the second bottom section.
Figure 11:
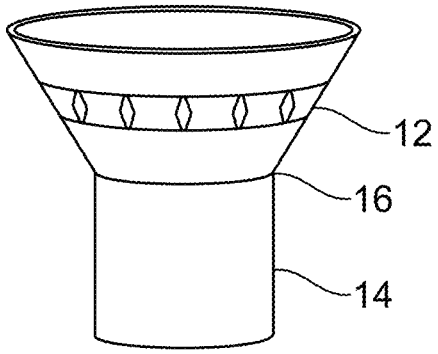
FIG. 11 illustrates a particular illustrative embodiment of the invention depicting an alternative shape of the container of FIG. 10.
Figure 12:
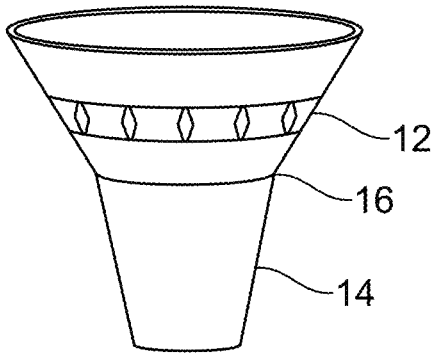
FIG. 12 illustrates of a particular illustrative embodiment of the invention depicting another alternative shape of the container of FIG. 10.

As shown in FIG. 9, container 70 has a sidewall 24 which encloses liquid receiving chamber 34. Container 70 has a closed bottom 26. The sidewall 24 is made out of a paperboard layer that is continuous and is formed into a tapered outer configuration with the bottom 26 being narrower and an open mouth of top end 28 of the container 70 being wider to provide access into the chamber 34. Container 70 is formed so as to be symmetrical about a longitudinal axis 15 extending through the center of the container 70. Container sections 12, 14, 16 form peripheral sidewall 24 and may have the shape of a truncated cone. However, it should be appreciated that the container may have other shapes such as those shown in FIGS. 11 and 12.

Container 70 further includes but is not limited to a floor or bottom 26 that is substantially planar and, in a plane, normal to the longitudinal axis 15 of the container 70. Bottom 26 forms a closure member to close the bottom end 32 of the container 70 and may be either formed integral with the peripheral sidewall 24 or attached to the peripheral sidewall 24 so as to form a liquid receiving container 34 open at its open mouth top end 28 and closed at its bottom end 32. Thus the sidewall 24 and bottom 26 encloses chamber 34 for containing water and receiving the stems of a floral product. It should be appreciated that container 70 is self-sufficient and does not require an additional container, such as a pot or a plastic bag, disposed inside the container. The open mouth of top end 28 of the peripheral sidewall 24 does not terminate in an annular rim. This annular rim 30 of the prior patent is not used as the annular rim resists deformation of the container. Moreover, the annular rim 30, if present would provide undesirable rigidity to the open end of the container making the top section 12 easily deformed when the middle section 16 collapsed into the in use state.

It should be appreciated that container 70 may have various shapes. As shown in FIG. 9, it is preferable that the sidewall 24 have the shape of a cone where the tapered wall of the first top section 12 has a slightly larger diameter than the tapered wall of the second bottom section 14. This permits containers 70 to telescope to the extent that the right-conical sidewall sections of one or more additional containers 70 containers into a stack of nested containers 70 that telescope downwardly within the corresponding wall section of the next container 70 below. This stackable shape allows multiple containers 70 to be stacked in a nested relation prior to use for both ease of shipment and reduced storage requirements upon arrival.

Turning now to FIG. 9, FIG. 9 is a side view of a particular illustrative embodiment of the invention. As shown in FIG. 9, top section 12 has an angle 36 with vertical 15 and a height 38, and bottom section 14 has an angle 40 with vertical 15 and a height 42. Middle section 16 also has an angle 44 with vertical 15 and a height 46. The sections 12, 14, 16 are preferably circular in cross-section and have a diameter D, varying with the taper of the sidewall 24. In additional illustrative embodiments of the invention, the angles 36, 40, and 44 are the same but it should be appreciated that these angles may vary from one another. For example angle 36 may be larger than angles 40, 44. It should also be appreciated that angles 36, 40, and 44 may be 90 degrees to form a cylindrical container 10. It should be appreciated that the container need not be conical throughout but may have a conical shape for a top section that has a greater diameter than a cylindrical shaped bottom section. See for example FIGS. 11 and 12.

Figure 10:
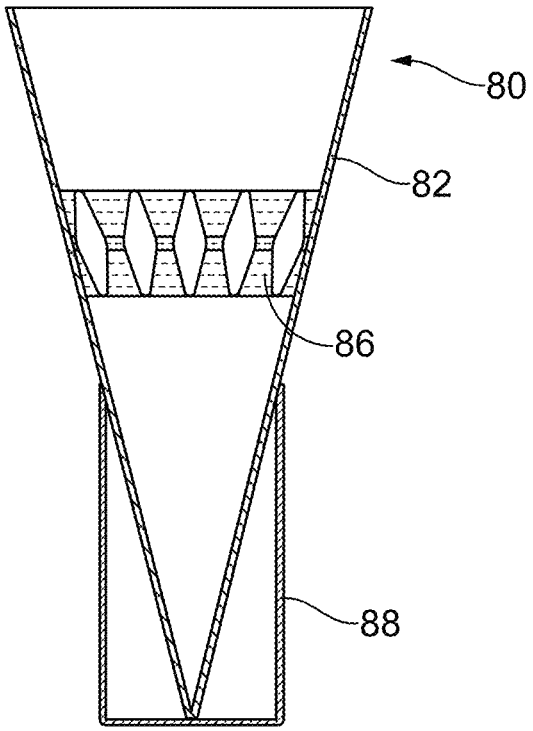
FIG. 10 illustrates a particular embodiment wherein container does not have a flat bottom but may be a cone only having a conical sidewall.

As shown in FIG. 10, in one embodiment, container 80 does not have a bottom but may be a cone only having a conical sidewall 82. The sidewall has a perforated middle section 86 having cutouts, ribs, and bending resistance relief, such as kiss cuts or indentions discussed above. In this embodiment, container 80 may include a stand 88 that may or may not be part of container 80. Stand 88 supports the product in an upright position. Stand 88 may or may not be a part of container 80.

Containers 10 and 70 as depicted herein are unitary and self-supporting. The containers may have any dimensions and their dimensions will be determined by a size of a wine bottle, a number of flowers, prepared food items to be housed in the container and the length and weight of the flowers, prepared food items or wine bottles. Also if the flowers are top heavy because the petals or heads of the flowers have a great weight and/or the stems are very long, the container must have a height that will support the flowers and a sufficient volume in the second bottom section 14 of the container to hold a counterbalancing weight, such as water, marbles, pebbles or the like, to the side force of the flower stems extending out of the container to prevent the container from tipping over. In alternative embodiments container 70 may have a height in the range from about three to about sixteen inches and a range of diameters from about 2.5 inches to about 12 inches. Preferably the height of the bottom section 14 is greater than the height of the top section 12. Preferably the height of the bottom section 14 is two-thirds the height of the container, Container 70 may be made of various materials. In additional alternative illustrative embodiments of the invention, container materials have a stiffness or rigidity whereby container 70 will hold the contents upright. Container 70 preferably will not collapse, buckle, or fold once the contents are inserted into container 70. Further, the container material is water proof made from paperboard semi-impermeable to liquid to allow container 70 to hold water for the flowers or any other product. Further the bottom 26 of container 70 has sufficient stiffness and rigidity so as to prevent the bottom 26 from being easily hand crushed or squeezed. For example, the material of container 70 may be paperboard, plastic, or PLA. Further container 70 is preferably composed of a paperboard or material such as PLA that is biodegradable in which the principal constituent is cellulose or vegetable fiber. The surface of container 70 may be rendered liquid-proof by coating the surface with a thin coating of a paraffin or microcrystalline wax, or with a thin coating of a synthetic high polymer or a plant based coating.

In a particular illustrative embodiment of the invention, the chosen material has an outside surface of the container that provides a medium for writing an individual message or machine printing a sentiment or holiday message. As with the decorative accessories 20 shown in FIG. 3, those skilled in the art will recognize that significant variation will be considered to be within the scope of the invention.

The middle section 16 is a pliable section of container 70 having dissimilar properties from the first top and second bottom sections 12, 14. In embodiments, the middle section 16 is of the same material as the top and bottom sections 12, 14. The material of the side of container 70 is preferably made from a common integral piece of material, i.e., is made of a unitary material.

The treatment of the material of container 70 in forming middle section 16 may take various forms to allow the middle section 16 to be collapsed inwardly, such as by crushing, folding, twisting, crimping, collapsing or other collapsing means, such as compressing, condensing, pinching or squeezing, while first top and second bottom sections retain a sufficient rigid structure to support the product in the container 70. This allows the sidewall 24 to be first rigid at first top section 12, then pliable at middle section 16, and then rigid again at second bottom section 14. In embodiments, the container is self-supporting prior to the insertion of a product and both before and after the middle section 16 is collapsed.

Container 70 is particularly designed to secure cut flowers in a water-containing container to serve as a temporary container. It should be appreciated, however, that container 70 may serve as a more permanent container and be decorated for the display of the flowers. During use, a floral product 18 is inserted into container 70 as shown in FIG. 2. Liquid such as water may be inserted prior to or after the insertion of the floral product 18. The collapsible middle section 16 is located above the water line. It is preferable to only include liquid such that the liquid is located in the second bottom section 14 of the container 70 after the insertion of the floral product 18. It is important to note that the fluid, such as water, in the second bottom section 14 of container 70 has the advantage of providing the weight advantageous to keeping the container 70 upright. In alternative embodiments, the middle section is located at approximately two-thirds the height of the container. The middle section 16 is collapsed allowing collapsible middle section 16 to collapse or fold inwardly around the stems of the floral product such that the container 70 is capable of securing about at least a section of the stem or stems of the floral product(s) 18 to support the floral arrangement in the container 70 with the liquid being contained in the second section 14 of the container 70 to maintain nourishment for the floral product 18. It should be appreciated container 70 is a container before the stems of the floral product are inserted and it remains a container after it is collapsed around the stems of the floral product.

Cutouts, ribs, fold lines and or kiss cuts are used to enable middle section 16 to be collapsed around the stems of the floral product 18 while the first top and second bottom sections 12, 14 remain non-collapsible so as to have sufficient stiffness or rigidity to support the floral product 18 upright in the container 70. The cutouts causes the material at middle section 16 to be pliable susceptible to being collapsed. Although the material is preferably the same for sections 12, 14, 16, the cutouts, ribs, fold lines and or and kiss cuts changes the structure of the material at middle section 16 from the structure of the material of sections 12, 14. The cutouts, ribs, fold lines and or kiss cuts causes the middle section 16 to be more easily deformable than the top and bottom sections 12, 14. The cutouts, ribs, fold lines and or and kiss cuts alter or weaken the fibers of the material causing the container to be pliable at middle section 16.

The ribs, cutouts, fold lines and or kiss cuts allows the container to be transformed from a conical shape container to a container having an hour glass shape with a reduced diameter middle section when the collapsible middle section ribs are collapsed radially inward toward a center longitudinal axis of the container. Further the cutouts and ribs in middle section 16 mark and identify the middle section 16 where the material can collapse and be grabbed, hand-held and carried. One treatment means includes chemically treating a predetermined area of the material forming sidewall 24 to weaken or soften the material forming the ribs causing it to be pliable and allowing the ribs to be collapsed while still allowing the first top and second bottom sections 12, 14 to maintain their stiffness or rigidity. One method of treating the ribs in middle section 16 is the use of a spray technique to weaken the ribs in middle section 16 of the sidewall 24. Another treatment means includes pre-stressing a predetermined area of the material to weaken that area of the material so as to allow it to be collapsed and still allow the first top and second bottom sections 12, 14 to maintain their stiffness or rigidity.

In another particular illustrative embodiment of the present invention another treatment means for a container 10 includes stamping or embossing a predetermined area of the material to form middle section 16. Embossing includes causing the material to swell or protrude; to raise parts of the material in relief from the material's surface by mechanical means; to raise parts of the material's surface to form protuberances by pressure against a steel die roller cut or engraved with a pattern; or to produce in relief by stamping on the material such as paperboard or other impressionable surface. Also flutes or grooves may be formed in the material to form the middle section 16. The ribs formed in collapsible section 16 may be crimped or embossed with a pleated design in order to facilitate collapsing, crushing, folding, twisting, or crimping the material to form a shape and to secure the product 18 as shown in FIGS. 2 and 3. A cross sectional view of the ribs of the middle section have a first diameter that is larger than a second diameter when the ribs are collapsed. Stamping or embossing may be performed on the interior side of sidewall 24 to direct inwardly the collapse of the ribs in middle section 16. The ribs formed in middle section 16 may have various shapes of pleats to facilitate the collapse of the ribs formed middle section 16.

A further treatment means includes forming cutouts and ribs in a predetermined area around the sidewall 24 as shown in FIG. 9 to weaken that area causing it to be susceptible to collapsing.

Referring again to FIG. 9, in embodiments, the treatment means includes cutting a plurality of cutouts 106 in the sidewall 24 at a predetermined area to form a plurality of ribs 103 around the middle section of the sidewall 24 to form middle section 16. The dimensions such as the width and longitudinal length of the cutouts and ribs are set to provide sufficient rigidity to support the first top and second bottom sections 12, 14 and to support the product in the container 70 without edges of the ribs touching during collapsing to reduce the internal diameter of the middle section of the container. The longitudinal length of the ribs 103 is preferably twice the length required of the ribs 103 to reach and engage the stems. The cutouts 106 are shaped as shown in FIG. 9 or of another shape, such as oval-shaped, leaf shape, elongated or another configuration so that ribs do not touch each other during collapsing the middle section and interfere with collapsing.

Kiss cut 100 on the outside of middle portion 16 at the top and bottom of the ribs and at the center of the ribs. Ribs 103 may have a kiss cut on the inside surface of the ribs at center the center of the ribs fold 102 allowing the ribs 103 to be collapsed inwardly either into engagement with the stems of the flowers or sufficiently near the stems to provide their support in container 70. This allows the collapsible middle section 16 to be inwardly foldable while the top and bottom sections 12, 14 are non-foldable. The ribs and cutouts allow collapse of the middle section without deforming top section and bottom sections, without an annular rim at the top of the container that, if added, would have provided support but resisted deformation of the top section during collapsing the middle section.

In operation, container 70 is a single unit container in that its pre-use condition is a container and its post-use is a container. Container 70 starts as a container and ends as a container. It is envisioned that a plurality of floral products may be supported or secured in container 70 including flower food and water for the health of the flowers. As shown in FIG. 3, a plurality of floral products 18 is disposed in a container 10 such that the middle section 16 supports or secures the floral products 18 in container 10. In embodiments the collapsible middle section 16 is located above a center of the container to support the at least one stem and extends around the container to form an annular collapsible section. In embodiments the container has a height that is greater than one-half the height of at least one stem to support the floral product upright. The middle section 16 may maintain itself in the inwardly collapsed position. The material and/or selection of treatment means may retain the middle section 16 in its inward position.

In the manufacture of container 70, sidewall 24 is formed from a sidewall blank which is die cut from a larger sheet of paperboard. In a particular illustrative embodiment of the invention, the sidewall blank is coated with a known waterproof material such as plastic. The bottom blank is coated on at least its inner surface with a similar waterproof material. Polyethylene is preferably used because it serves as both an adhesive or heat treatable material and a waterproof coating. Other types of biodegradable and/or recyclable waterproof and heat sealable coatings have been developed within the industry.

The sidewall 24 is treated by one of the treatment means. By passing the sidewall blank through an appropriate die or spray at a predetermined area on the sidewall blank. The kiss cut may be on the interior of the sidewall to assist in directing the inward collapse of middle section 16. Container bottom 26 is attached to the sidewall 24 of the container 70. The container bottom 26 is formed and then the container sidewall 24 is wrapped around the bottom 26 with the sidewall 24 being attached to the bottom 26 by an adhesive or heat treatment. Prior to being wrapped with the sidewall, the cup bottom is formed by passing a paperboard web across the cutter which cuts out a circular blank, as per standard paper cup manufacturing.

The bottom 26 comprises a disc-shaped base 60 and a cylindrical lip or skirt 62 projecting from an outer periphery of the base 60. The sidewall 24 is wrapped around the circumference of the lip 62, and an end 64 of the sidewall 24 is folded over the free edge of the lip 62. The lip 62 thus becomes sandwiched between sections of the container sidewall 24 and is bonded thereto by an adhesive or heat treatment. The edges of the sidewall are then glued, or heat treated to form a side seam. After container 70 has been manufactured, no assembly is required prior to use.

It should be appreciated that the container may be used to house objects other than floral products. For example, the container may house pencils, crayons, dried bamboo shoots and other dried floral materials or collectibles. The container would no longer need to be waterproof and only its dimensions would be varied to accommodate the objects to be housed in the container such as prepared foods and wine bottles.

Substantially vertical ribs are formed between substantially vertical cutouts in the middle section that make the ribs easier to bend by making substantially horizontal fold lines in the top, bottom, and center of the ribs. In a particular illustrative embodiment of the invention the fold line is a substantially horizontal indention is made on the outside surface and inside surface of ribs formed between cutouts in the container to reduce rigidity and resistance to folding of the ribs toward the indention. The indention reduces the rigidity of the container at the indention. In one particular embodiment of the invention the invention the fold line is a substantially horizontal depression is formed in the inside and/or outside surface of the container to reduce resistance to bending of the ribs and to facilitate bending of the ribs formed between the cutouts made in the middle collapsible section of the container. In one particular embodiment of the invention the horizontal indention is a depression made in the inside and outside surface of the container. In another particular embodiment of the invention, the indention can also be made by a chemical process. In another particular embodiment of the invention, the indention can also be made by a 3d printing process.

In another particular embodiment of the invention, the fold line is a substantially horizontal "kiss cut" is made on a surface of a top end, a bottom end, and a middle of substantially vertical rib by a cutting die or another cutting means.

Converse to the indention, where bending is reduced toward the indention, with a kiss cut, bending is reduced away from the kiss cut. In a particular embodiment of the invention, a kiss cut is made on the outside of container material at the top of a rib formed by material between two cutouts in the middle collapsible section of the container left after die cutting or 3d printing the cutouts in the middle collapsible section of the container. In another particular embodiment, a second kiss cut is made on the inside of the container in the center of the rib to facilitate the center of the rib folding inward during collapsing of the middle collapsible section of the container. A kiss cut for folding laminated paperboard is a precise cut through the top layer of a laminated sheet of paperboard, leaving the bottom layer intact. This technique has been used in the past for applications like stickers, labels, decals, and other printed materials that need to be easily peeled away from a backing sheet without damaging the adhesive or heat treatment or the backing material. Conversely, in the present invention, horizontal kiss cuts are made on the top and bottom sections of the vertical ribs on the outside surface of the container to facilitate folding of the top and bottom of the ribs inward toward a central vertical axis of the container and away from the outside surface of the container upon which the kiss cut is made. Thus the kiss cut top layer opens up as the bottom layer is bent away from the kiss cut.

A kiss cut is made on the outside of the container. The outside kiss cut, cuts through the outside surface of the container, which is an outside laminated layer of paperboard when the container is made of laminated paperboard. The outside kiss cut at the top and bottom of the rib reduces rigidity of the rib at the location of the kiss cut and thereby facilitates folding of the top and bottom of the rib inward by reducing resistance to folding of the outside surface of the container when the middle collapsible section is folded inward. Additionally an inside kiss cut is also made at the inside surface at the center of the rib to reduce rigidity of the rib at the location of the kiss cut, thereby reducing resistance of the center of the rib from bending and folding inward away from the inside center kiss cut. Circumferential indentions are also used to reduce rigidity of the ribs and facilitate folding when the container is made of plastic or PLA.

In a particular illustrative embodiment of the invention, the container is formed from a laminated sheet of paperboard, having two or more sheets of paperboard laminated together to form a laminated sheet of paperboard having two or more layers. Kiss cutting is a precise cutting method where a specialized cutting tool, such as a rotary die or a laser, is used to cut only into a top layer of the laminated sheet without cutting through the other sheets of the laminated paperboard. The term "kiss" in kiss cut implies that the cutting tool just barely touches or "kisses" the surface of the top layer. The pressure and depth of the cutting tool are carefully controlled to ensure that it cuts through the top layer of the laminated paperboard but not the second of the laminated paperboard. This is achieved by adjusting the settings of the cutting machine to match the thickness and properties of the laminated material. The depth of the kiss cut can be adjusted so that the kiss cut penetrates a desired depth in the container that can be more or less than the thickness of the outside layer of the laminated paperboard. Kiss cuts can also be used by making controlled depth cuts in a non-laminated material such as plastic for PLA. The depth of the kiss cuts are varied for making the container out of plastic and PLA to reduce the rigidity of the ribs and facilitate folding of the ribs during collapse of the container made of plastic or PLA.

The kiss cut on the inside surface of the center of the rib facilitates folding of the rib inward by reducing the resistance of the inside sheet of the laminated paperboard by cutting it. The kiss cuts on the top and bottom of the ribs on the outside surface of laminated paperboard facilitate folding of the top and bottom ribs inward by reducing the resistance of folding inward of the outside laminated paperboard layer forming the outside of the container.

Kiss cuts are also employed when the container is made of materials other than paperboard, such as plastic or PLA when the container is printed in 3 dimensions using a 3d printer and PLA. In the case when the container is made out of a material other than paperboard, the kiss cuts are adjusted cut into the surface of the container one half to one third of the thickness of the material of which the container is manufacture, into the outside and inside of the material making up the container at the same locations described above. In another particular embodiment of the invention a chemical process is used instead to score or cut into the non-paperboard material making up the container. In another particular illustrative embodiment of the invention, the laminated paperboard is kiss cut using a chemical process. In another particular illustrative embodiment of the invention, a laser is used to make the kiss cuts in the material of which the container is made.

In another particular illustrative embodiment of the invention, the container having a collapsible middle section is suitable for use in cold chain processing. The importance of managing the cold chain in cut flower supply chains has grown significantly due to the greater distances between markets. A recent research study has identified potential methods to capitalize on the benefits of investing in cold supply chains for cut flowers. The study suggests that, beyond the current external quality criteria employed in the grading system at flower auctions, internal quality factors such as container life should also be taken into consideration. The underlying assumption is that incorporating internal quality attributes, like container life, into the evaluation process will lead to the realization of the value associated with investing in cold chain management. Flowers that have been properly handled within a well-managed cold chain are more likely to exhibit extended container life, making them more appealing to buyers and potentially commanding higher prices. The container is also suitable for shipping ornamental garden bulbs in food safe paperboard containers and in the cold chain management process.

In another particular illustrative embodiment of the invention, the container is a food quality container suitable for using in storage and transportation of prepared foods, such as candies, popcorn, pretzels and wrapped with a decorative plastic sleeve around the outside of the container.

In another particular illustrative embodiment of the invention a cutout is made at one end of the paperboard stock that is folded into a cone by joining the opposite ends of the paperboard stock by a substantially vertical seam that is formed into a container. The cutout 107 as shown in FIG. 5, reduces a volume of paperboard overlapping at the seam and reduces the rigidity and resistance to bending at the seam joining opposite ends of the paperboard that are joined together using a vertical seam.

In a particular illustrative embodiment of the invention, the container having a collapsible middle section is a disposable floral container that is lightweight for shipping flowers via ground or air freight. The container is also disposable at destination resulting in fewer plastic containers in landfill. In another particular illustrative embodiment of the invention no pesticides are necessary when using the container as a clean container is provided with each use in the growing fields, thus there is no need to sanitize the disposable container after each use as was a prior requirement with reusable plastic containers. In a particular illustrative embodiment of the invention, the containers are stackable providing minimal storage requirements and are mass produced using standard coated paperboard providing a low cost per unit. The containers are waterproof and suitable for use with flower food and in cold chain processing facilities.

In a particular illustrative embodiment of the invention, coated craft paperboard is used to manufacture containers having collapsible middle sections. The paperboard container having a collapsible middle section when manufactured into a container is lightweight for shipping flowers via air freight or ground shipping. The paperboard container having a collapsible middle section also has the advantage of fewer plastic containers in landfill or to return to growers. The paperboard container having a collapsible middle section is disposable so that there is no need to clean a reusable plastic container with each use in the growing fields or for shipping. Moreover, there is no sanitizing as required with plastic buckets. The containers have a collapsible middle section and are stackable with minimal storage requirements. Manufacturing containers having collapsible middle sections without a top rim also lowers manufacturing costs per unit as fewer steps are involved, which saves time of manufacture.

In a particular illustrative embodiment of the invention the bottom section of the container is soak proof and is suitable fit for use with flower food and in cold chain processing facilities. Paperboard containers are manufactured to protect against contamination and bacterial growth. In a particular illustrative embodiment of the invention, the container provides a farm-to-container container that has been evaluated for prolonged use, one week, with flower food at 38° F. In another particular illustrative embodiment of the invention, manufacturing includes clean room environments using food safe die, paperboard and cup forming equipment.

In a particular illustrative embodiment of the invention, the container is manufactured in accordance with ISO 22000 which is a food safety management system by the International Organization for Standardization (ISO) which is outcome focused, providing requirements for any organization in the food industry with the objective to improve overall performance in food safety. These standards are intended to ensure safety in the global food supply chain. The standards involve overall guidelines for food safety management and also focuses on traceability in the fee and food chain. Food safety refers to all the hazards, whether chronic or acute, that may make food injurious to the health of the consumer. The container has numerous uses that do not include storage of water in the bottom section of the container. The food safety standards make the container safe for prepared foods and floricultural products.

Figure 15:
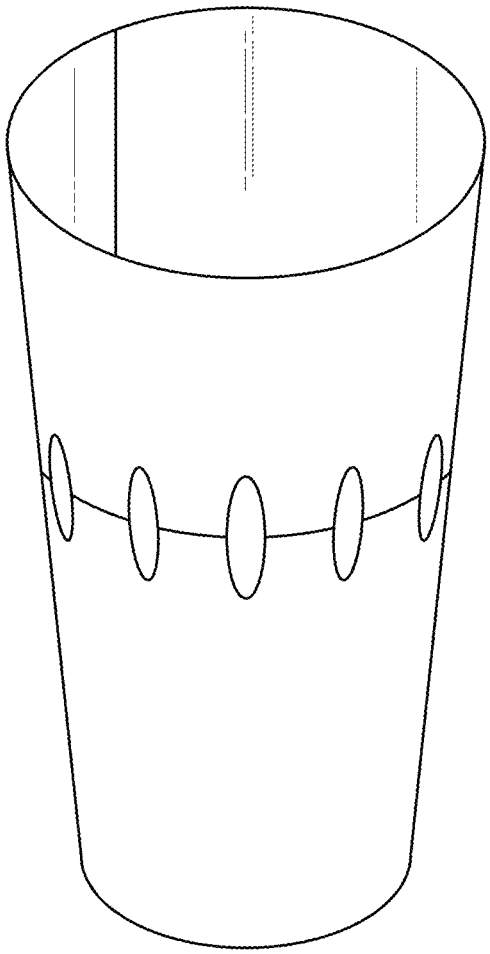
FIG. 15 depicts a detail of the cutouts in a particular illustrative embodiment of the invention wherein the cutouts are in the shape of an oval.

In another particular illustrative embodiment of the invention, the shape of the cutouts varies as long as the ribs formed by the cutouts do not touch each other during collapsing of the middle section. In another particular embodiment of the invention, the cutouts can be any shape as long as the ribs do not interfere with each other when folding inward when middle section of the container is collapsed. FIG. 15 depicts a detail of the cutouts in a particular illustrative embodiment of the invention wherein the cutouts are in the shape of an oval.

Figure 16:
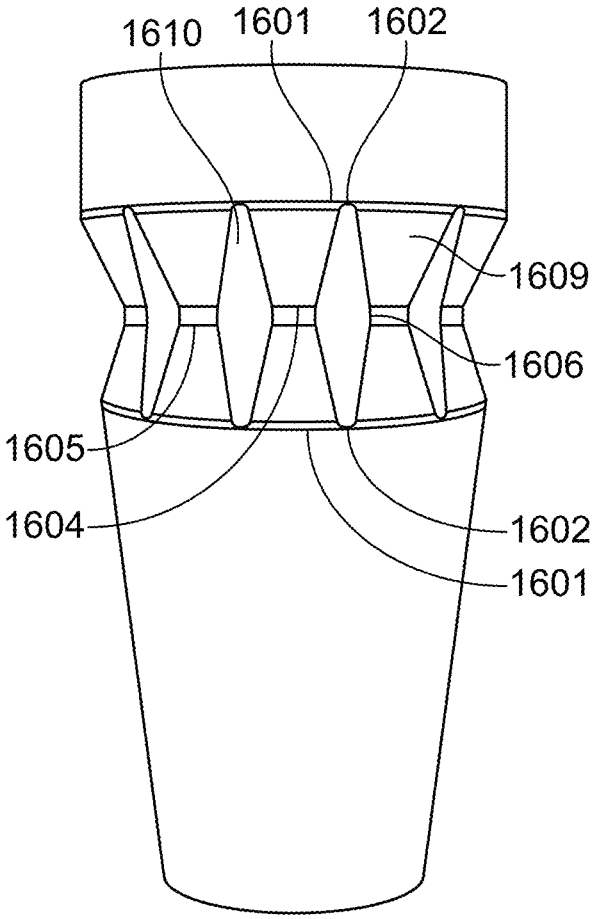
FIG. 16 depicts a detail of the cutouts in a particular illustrative embodiment of the invention.

FIG. 16 depicts a detail of the symmetrical cutouts in a particular illustrative embodiment of the invention. As shown in FIG. 16, the top end 1602 of a cutout has a rounded shape curved peak of an acute angle at the top and bottom of the cutout 1610 to facilitate removing the piece of paperboard from the cutout during manufacture of the container, without leaving a remnant of paperboard or chads in the cutout. The side of the cutout 1606 forms an obtuse angle to facilitate removing the piece of paperboard from the cutout without leaving a remnant of paperboard or chads in the cutout. Prior cutouts with acute angle ends or sides were prone to leaving remnants of paperboard in the cutout when removing the section of paperboard that is cut from the paperboard blank to form the cutout during manufacture of the container. Fold lines 1601,1604 and 1605 facilitate folding of the ribs 1609 formed between the cutouts 1610. The top and bottom ends 1602 form an acute angle with a curved peak at the top and bottom of the cutout, wherein the left side and right side 1606 of the cutout are configured to form an obtuse angle. The middle portion of the cutout is wider than the top and bottom ends of the cutout. The ribs 1609 formed between the cutouts 1610 have a complimentary shaped, have been formed by the cutouts 1610.

Figure 17:
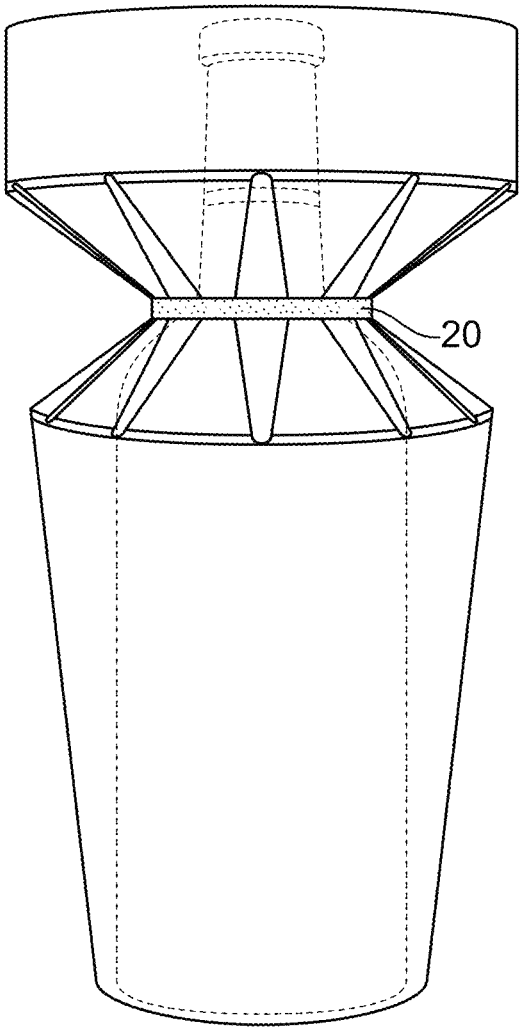
FIG. 17 depicts a container holding a wine bottle.
Figure 18:
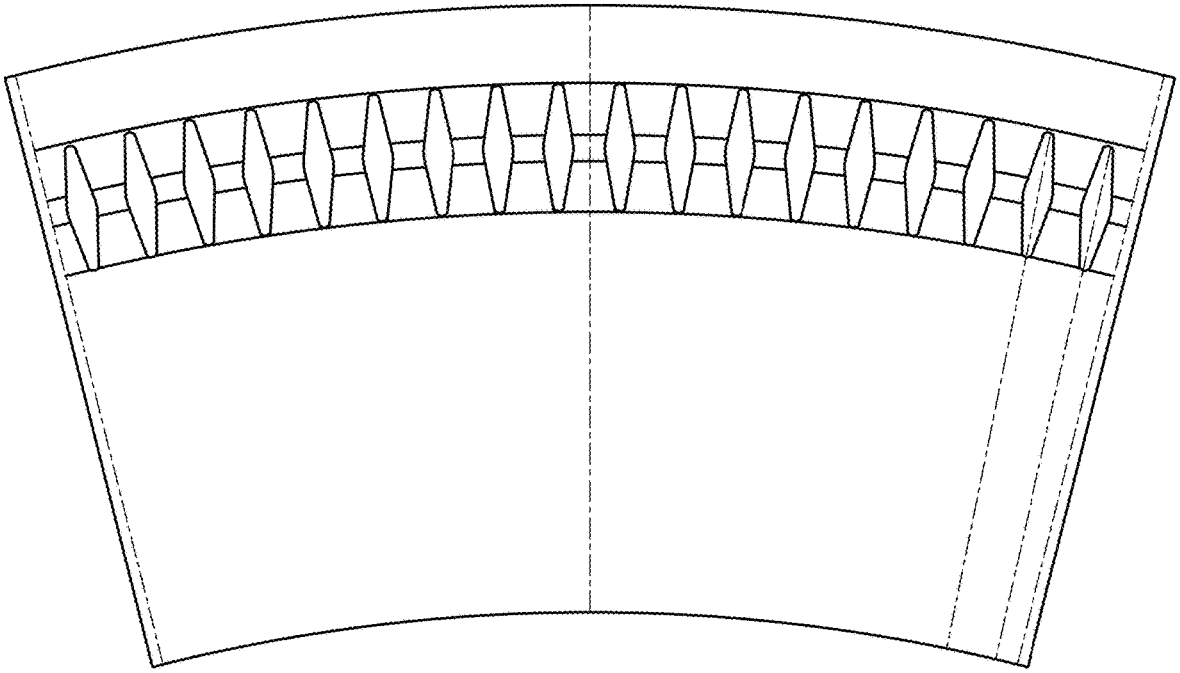
FIG. 18 depicts proportions of a container from a paperboard blank for particular illustrative embodiment of the invention.
Figure 19:
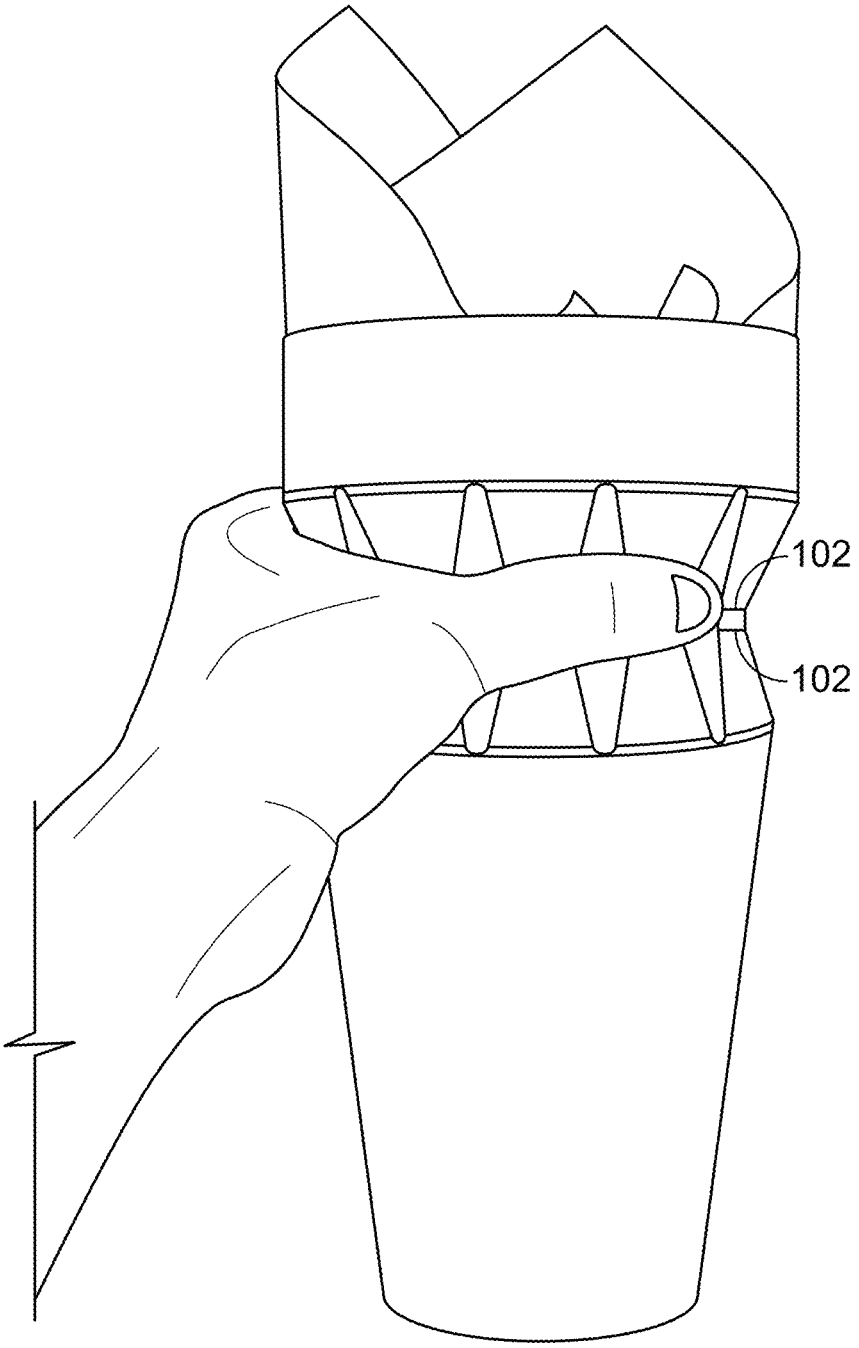
FIG. 19 depicts a container for a hand held grab-and-go prepared food item without a tie.
Figure 20:
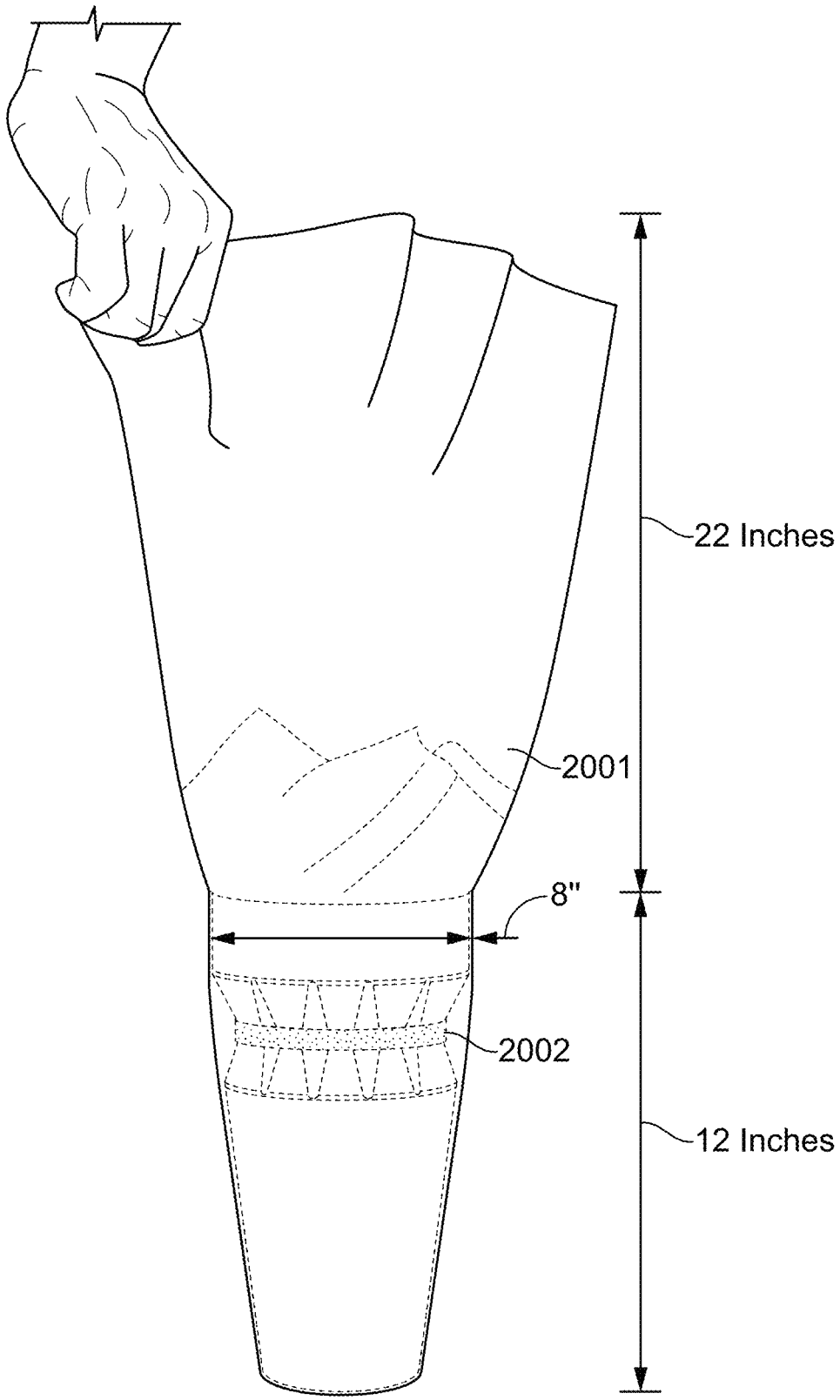
FIG. 20 depicts a coated craft sleeve surrounding a container in a particular illustrative embodiment of the invention.

FIG. 17 depicts a container holding a wine bottle. The bottom section is taller so that the collapsible middle section engages the neck of the wine bottle above the body of the wine bottle body. A tie 20 surrounds the collapsed middle section to secure the wine bottle in the container. The container is useful for promotional and gift packaging for a bottle of wine. FIG. 18 depicts the proportions of the dimensions for manufacture of a container from a paperboard blank for containing a wine bottle in particular illustrative embodiment of the invention. FIG. 19 depicts a container for a hand held grab-and-go food item without tie 20. In a particular embodiment of the invention the container of FIG. 19 fits most car cupholders and provides an additional advantage of a design that meets the Universal Design concepts at the hand-held middle section. The container is suitable for children and is accessible for use regardless of age or disability. FIG. 20 depicts a coated craft paper sleeve surrounding a container in a particular illustrative embodiment of the invention. The craft paper 2001 acts as a handle for carrying the container. The sleeve can also be made out of plastic or another suitable material. A tie 2002 is used to hold the flowers upright within the collapsed middle section. The craft paper sleeve make the container easy to grip when a heavy product is inserted into the container. This embodiment of the container is useful for containing flowers harvested in the field, which becomes heavy with the contents of the harvested flowers. The container is 12 inches tall, and the craft paper extends 22 inches above the top of the container.

Figure 21:
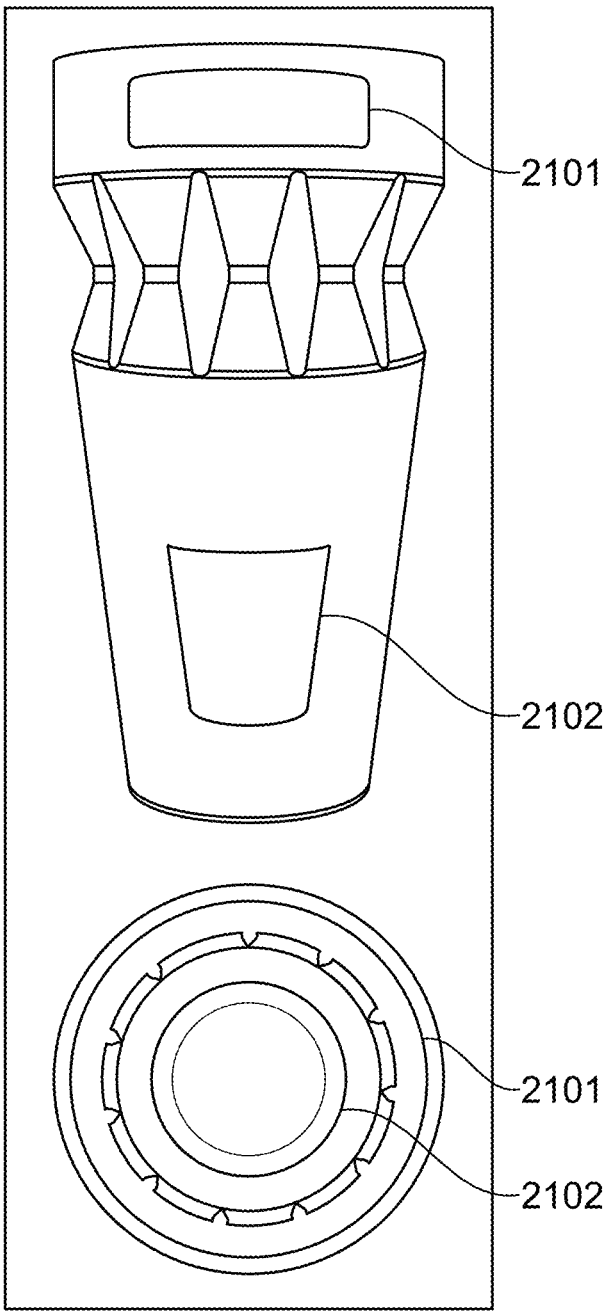
FIG. 21 depicts a container used for serving prepared food items wherein a main food item such as a prepared piece of chicken is placed in the bottom section of the container and a side dish or condiment is placed in the top section of the container.

FIG. 21 depicts a container used for holding prior to serving prepared food items wherein a main prepared 2102 food item such as pieces of chicken, chicken fingers, and chicken nuggets are placed in the bottom section of the container. A side dish 2101 such as mashed potatoes is stored in a smaller package is placed in the top section of the container above the collapsible middle section.

A food side dish container can be stacked in the space above the collapsible section (or a loose fitting container lid can be used). The cutouts function as vents. In another particular illustrative embodiment of the invention, no tie around the collapsible section is necessary to secure prepared food items in the container. The collapsible section reduces diameter of the container thereby engaging and securing the flowers in the container having a collapsible middle section, wherein the container serves as a grab-and-go feature. The grab-and-go feature for flowers uses a tie around the collapsible middle section. The grab-and-go for prepared fast food items is used without a tie around the collapsible middle section.

In a particular illustrative embodiment of the invention, the container is manufactured and configured as packaging that holds water for the easy transportation and the health of the flowers contained in the container. The inventor has identified available paper cup forming equipment and paperboard to manufacture the container using sidewall die cutting. In a particular illustrative embodiment of the invention, clean room manufacturing (food safe certified) is provided to manufacture the container. In a particular illustrative embodiment of the invention, the container has been water tested for 7 days with the cold chain processing conditions of 38° F.

In the '566 patent, the narrow parallel slits, when cinched, tore the fibers of the paperboard. The narrow parallel slits also interfered with each other by touching during collapsing of the middle section. In the present invention the cutouts in the middle section are not narrow parallel slits in the collapsible middle section.

In a particular illustrative embodiment of the invention the cutouts leave at least 50% material between cutouts, also referred to herein as "ribs," between edges of the cutouts to maintain structural stability. The cutouts are designed so that side edges of the ribs formed by the cutouts do not touch each when the collapsible middle section is collapsed and reduced in diameter to secure the flowers or other product placed in the container. The cutouts are an improvement over prior narrow parallel slits which tended to crumple and deform the top section of the container. Moreover, in an illustrative embodiment of the present invention, there is an improvement provided by not having a top rim, as the top rim that was required in the '566 patent resisted deformation of the container. In a preferred embodiment of the present invention, the wider cutouts resist deformation of the top section of the container, without the need for a top rim, when the middle section of the container is collapsed and reduced in diameter to secure the flowers for transportation.

While particular embodiments of the subject Invention have been described, it will be obvious to those skilled in the art that various changes and modifications of the subject invention can be made without departing from the spirit and scope of the invention. It will be clear to those skilled in the art that various changes and modifications may be made without departing from the scope of the invention and the invention is not to be considered limited to the embodiments, uses and examples that are described in the specification.

The invention claimed is:

1. An apparatus, the apparatus comprising:

a container having a semi-rigid top section, a semi-rigid bottom section and a collapsible middle section, wherein the container has ag non-collapsed shape, wherein the top section is open to receive an item, the middle section is configured having a non-collapsed shape with an non-collapsed diameter, wherein the collapsible middle section is configured to be depressed inwardly to form a collapsed middle section that has a collapsed diameter smaller than the non-collapsed diameter, wherein the container is configured to receive a product in the non-collapsed shape and wherein the collapsible middle section is depressed radially inwardly to secure the product in the container;

a longitudinal axis for the container, wherein the longitudinal axis is vertical;

cutouts formed in the collapsible middle section wherein the cutouts have a top end, a bottom end, a left side and a right side, and a middle portion of the cutout between the top end and the bottom end, wherein the middle portion of the cutout is wider than the top end and the bottom end of the cutout; and ribs formed on each side of the cutouts, wherein the cutouts are configured so that edges of the two ribs on each side of the cutout do not touch each other when the middle portion is collapsed, wherein the top and bottom ends of the cutouts are configured with a rounded peak at the top and bottom of the cutout to facilitate removing a piece of paperboard from the cutout during manufacture of the container, without leaving a remnant of paperboard or chads in the cutout at top and bottom ends of the cutout, wherein the ribs formed between the cutouts configured to fold radially inward toward the longitudinal axis when the collapsible middle section is depressed radially inwardly toward the longitudinal axis of the container.

2. The apparatus of claim 1, wherein the top section does not have a top rolled rim.

3. The apparatus of claim 1, wherein the container is made from a material that is semi-impermeable to liquid.

4. The apparatus of claim 1, further comprising:

a first horizontal fold line on an outside surface of a top section of at least one of the ribs wherein the first horizontal fold line facilitates bending of the ribs formed in the middle section inward.

5. The apparatus of claim 4, wherein the fold line is formed by a kiss cut, the container further comprising:

a first horizontal kiss cut on an inside surface of the middle section of at least one of the ribs wherein the first horizontal kiss cut facilitates bending of the middle section of the ribs inward.

6. The apparatus of claim 4, wherein the first horizontal fold line is made by a laser cut.

7. The apparatus of claim 4, in the first horizontal fold line is made by a chemical process.

8. The apparatus of claim 4, where in the first horizontal fold line is made by a die cut.

9. The apparatus of claim 1, wherein the top and bottom ends of the cutouts form an acute angle with a squared off peak at the top and bottom of the cutout.

10. The apparatus of claim 9 wherein the left side and right side of the cutouts are each configured to form an obtuse angle.

11. The apparatus of claim 4, wherein the container is made by a three dimensional printer using a PLA material and the first fold line is made by the three dimensional printer.

12. The apparatus of claim 1, further comprising:

a second horizontal fold line made on an inside surface of a middle section of at least one of the ribs on each side of the cutout wherein a second horizontal fold line facilitates collapsing of top section of the ribs inward.

13. The apparatus of claim 12, further comprising:

a third horizontal fold line on an outside surface of the bottom section of the ribs on each side of the cutout wherein the third horizontal fold line facilitates collapsing of the bottom section of ribs inward.

14. The apparatus of claim 1, wherein the container is a food safe container, and the product is a prepared food.

15. The apparatus of claim 1, wherein the product further comprises water, wherein the water is stored in the bottom section of the container.

16. The apparatus of claim 1, wherein the container is suitable for cold chain processing of the product in the container.

17. The apparatus of claim 1, wherein the container is stackable within another container.

18. The apparatus of claim 1 wherein the container is self-sufficient and does not require an inner member to contain the product.

19. The apparatus of claim 1 wherein the collapsible middle section is collapsed inwardly to a second position while the non-collapsible top and bottom sections retain their shape to support the product stored in the container.

20. The apparatus of claim 1, further comprising:

a paperboard blank for forming the container, the paperboard blank having a right edge and a left edge; and a cutout made in right edge of the paperboard blank configured to reduce rigidity of a seam formed by overlapping the left and right edges of the paperboard blank, and wherein the cutout reduces an amount of material forming the seam.

21. A method of containing at least one product, the method comprising:

providing a container having a first section, a second section, and a collapsible middle section between the first section and the second section, the sections all being made of a common integral piece of non-collapsible material;

forming cutouts in the middle section of the container to form ribs in the middle section cutouts formed in the collapsible middle section wherein the cutouts have a top end, a bottom end, a left side and a right side, and a middle portion of the cutout between the top end and the bottom end, wherein the middle portion of the cutout is wider than the top end and the bottom end of the cutout;

ribs formed on each side of the cutouts, wherein the cutouts are configured so that edges of the two ribs on each side of the cutout do not touch each other when the middle portion is collapsed, wherein the top and bottom ends of the cutouts form an acute angle with a curved peak at the top and bottom ends of the cutout to facilitate removing a piece of paperboard from the top and bottom ends of the cutout during manufacture of the container, without leaving a remnant of paperboard or chads in the top and bottom ends of the cutout, wherein the ribs formed between the cutouts configured to fold radially inward toward a longitudinal axis when the collapsible middle section is depressed radially inwardly toward the longitudinal axis of the container;

placing a product into the container; and collapsing the middle section to retain the product in the container.

* * * * *